US005707682A

United States Patent [19]

Patel et al.

[11] Patent Number: 5,707,682

[45] Date of Patent: Jan. 13, 1998

[54] METHOD OF MANUFACTURING A PHOSPHOR SCREEN

[75] Inventors: Himanshu M. Patel, Escondido, Calif.; Antimo Pezzulo, Anagni, Italy

[73] Assignee: Videocolor S.p.A., Italy

[21] Appl. No.: 756,841

[22] Filed: Nov. 26, 1996

[30] Foreign Application Priority Data

May 16, 1996 [IT] Italy ..... MI96A0987

[51] Int. Cl.[6] ..... B05D 5/06

[52] U.S. Cl. ..... 427/71; 427/68; 430/35; 430/26; 510/180; 510/163; 510/422; 510/506

[58] Field of Search ..... 430/25, 26; 427/71–73, 427/68; 510/180, 163, 422, 506

[56] References Cited

U.S. PATENT DOCUMENTS

| | | | |
|---|---|---|---|
| 3,652,323 | 3/1972 | Smith | 117/97 |
| 3,837,885 | 9/1974 | Angelucci, Jr. | 427/68 |
| 3,966,474 | 3/1976 | Harper | 430/23 |
| 4,219,587 | 8/1980 | Oba et al. | 427/68 |
| 5,108,858 | 3/1992 | Patel et al. | 430/25 |

FOREIGN PATENT DOCUMENTS

| | | | |
|---|---|---|---|
| 55-72339 | 5/1980 | Japan | 427/68 |
| 58-14445 | 1/1983 | Japan . | |
| 60-143545 | 7/1985 | Japan . | |

OTHER PUBLICATIONS

McCutchen's "Emulsifiers and Detergents, North American Ed. (1982)" pp. 215, 276 & 279.

*Primary Examiner*—Martin Angebranndt

*Attorney, Agent, or Firm*—Joseph S. Tripoli; Dennis H. Irlbeck; Vincent J. Coughlin, Jr.

[57] ABSTRACT

A method of manufacturing a phosphor screen (22) on an interior surface (23) of a faceplate panel (12) is characterized by the steps of: forming a light-absorbing matrix (24) on an interior surface (23) of the faceplate panel (12); applying an aqueous surfactant solution thereto to solubilize oily contaminants and emulsify undissolved oily contaminants of the matrix (24); and serially applying three light-emitting phosphors (G, B, R) to the interior surface (23) of the faceplate panel (12) to form the phosphor screen (22).

4 Claims, 2 Drawing Sheets

Fig. 3
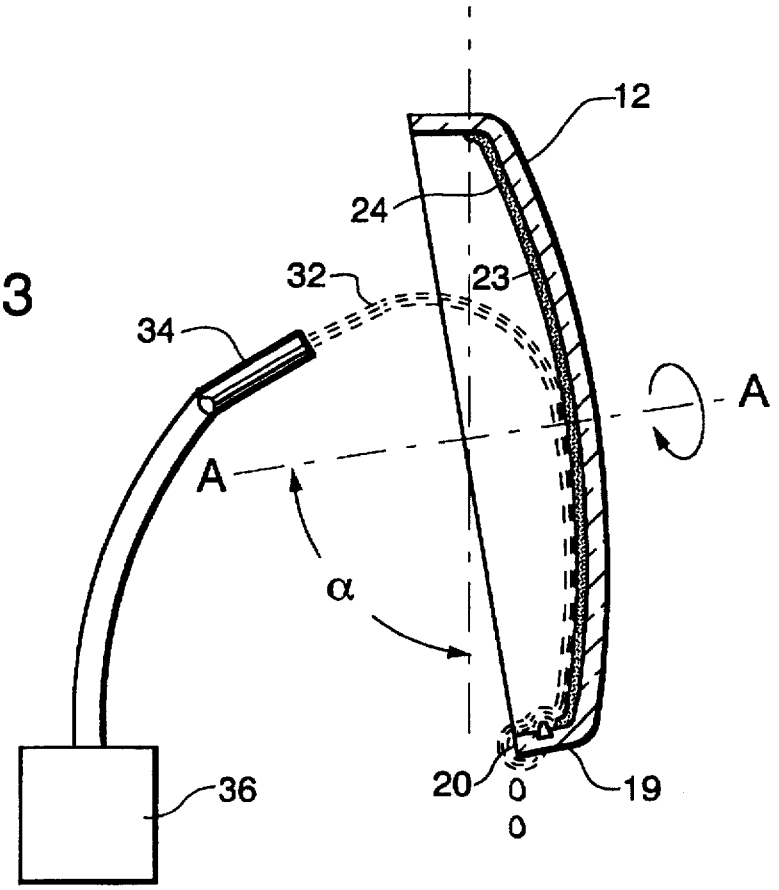
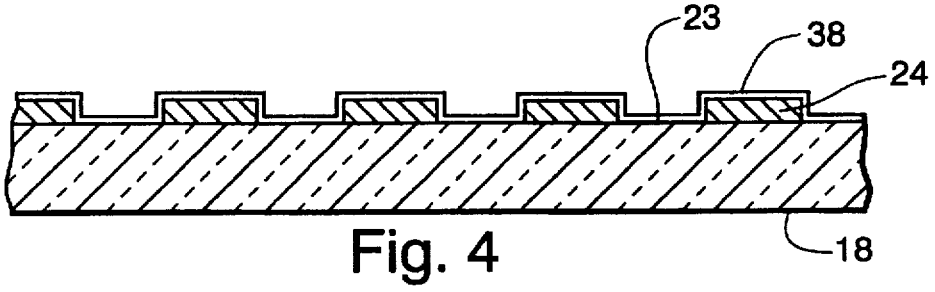
Fig. 4
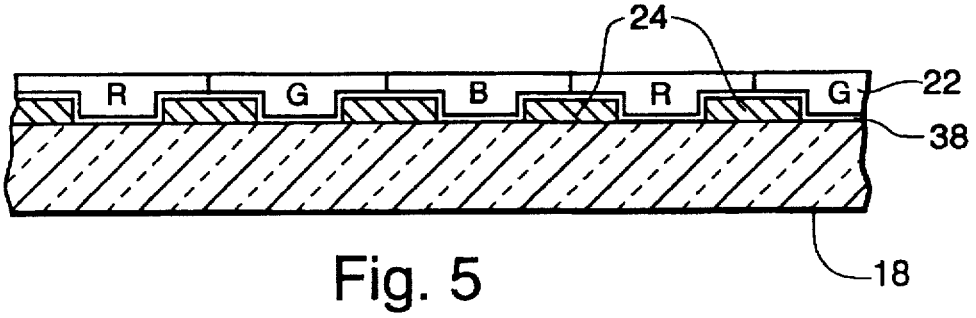
Fig. 5

METHOD OF MANUFACTURING A PHOSPHOR SCREEN

The invention relates to a method of manufacturing a phosphor screen for a cathode-ray tube (CRT) and, more particularly, to a method of improving the application of the phosphors to an underlying light-absorbing matrix.

U.S. Pat. No. 5,108,858, issued to Patel et al. on Apr. 28, 1992, describes a method of making a light-absorbing matrix on an interior surface of a faceplate panel of a CRT. Initially, the interior surface of the faceplate panel is coated with a photosensitive polymeric material and dried. Then the coating is exposed, through a shadow mask, to light to selectively alter the solubility of the coating. The more soluble areas of the coating are developed with water leaving open areas, while the less soluble areas of the coating are retained on the interior of the faceplate. The matrix is formed by applying a colloidal graphite solution to the interior surface of the faceplate, as described in U.S. Pat. No. 3,652,323, issued to Smith on Mar. 28, 1972. The colloidal graphite solution is dried and exposed to a suitable oxidant that dissolves the less soluble areas of the retained coating on the interior surface of the faceplate panel. The dissolved areas, with the colloidal graphite material thereon, are developed and flushed away with water, leaving the light-absorbing matrix adhered to the interior surface of the faceplate panel.

The colloidal graphite solution of the matrix contains hydrophobic contaminants from a pump and solenoid valves of a regulator that dispenses the colloidal graphite solution. The contaminants are not completely removed by the oxidant which dissolves the retained areas of the photoresist film, or by the water flush that carries away the dissolved film and the overlying dried colloidal graphite material. Accordingly, slight traces of the hydrophobic contaminants are carried over to the subsequent phosphor slurry application. The hydrophobic contaminants create voids in the phosphor coating resulting in an increase in phosphor screen rejects. An additional problem with the conventional matrix process is that after the matrix is formed, the matrix is somewhat rough, on the gun-facing side of the faceplate panel, and some graphite particle erosion occurs during the application of the first phosphor slurry. The phosphor particles in the slurry are abrasive and a small quantity of the graphite in the matrix is removed during the application of the first phosphor slurry, which is usually the green-emitting phosphor. The graphite particles, removed during the application of the first slurry, contaminate the first phosphor and lead to additional screen rejects.

The problem to which the present invention is directed is to overcome the hydrophobic contamination created by pumping and dispersing the colloidal graphite solution, and the erosion of graphite particles from the matrix formed on the interior surface of the faceplate panel.

SUMMARY OF THE INVENTION

According to the present invention, a method of manufacturing a phosphor screen on an interior surface of a faceplate panel of a cathode-ray tube includes the steps of forming a light-absorbing matrix on the interior surface of the panel, and applying an aqueous surfactant solution thereto to solubilize oily contaminants and emulsify undissolved oily contaminants of the matrix. Then, three different light-emitting phosphors (G, B, R) are applied to the interior surface of the faceplate panel to form the phosphor screen.

BRIEF DESCRIPTION OF THE DRAWINGS

The invention will now be described in greater detail, with reference to the accompanying drawings in which:

FIG. 3 shows a faceplate panel at a prior step in the screen manufacturing process;

FIG. 4 shows the faceplate panel at a subsequent step in the screen manufacturing process; and FIG. 5 shows the faceplate panel at yet another subsequent step in the screen manufacturing process.

DETAILED DESCRIPTION OF THE PREFERRED EMBODIMENTS

Figure 1:
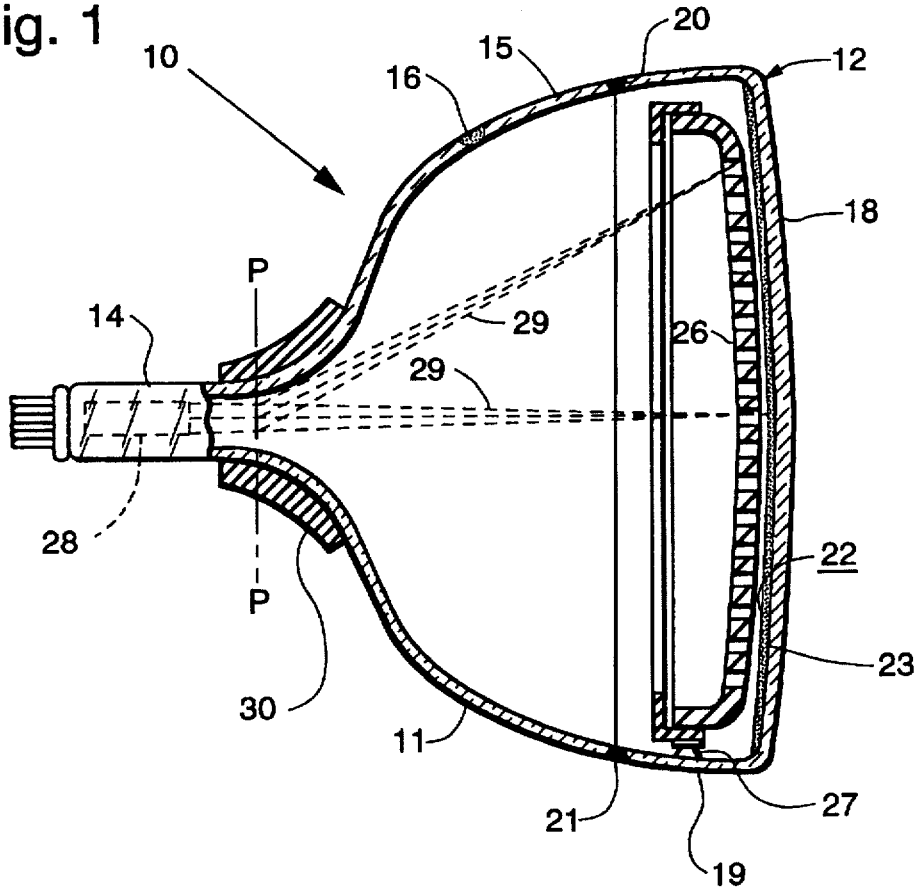
FIG. 1 is a partially broken-away longitudinal view of a CRT made according to the present invention.
Figure 2:
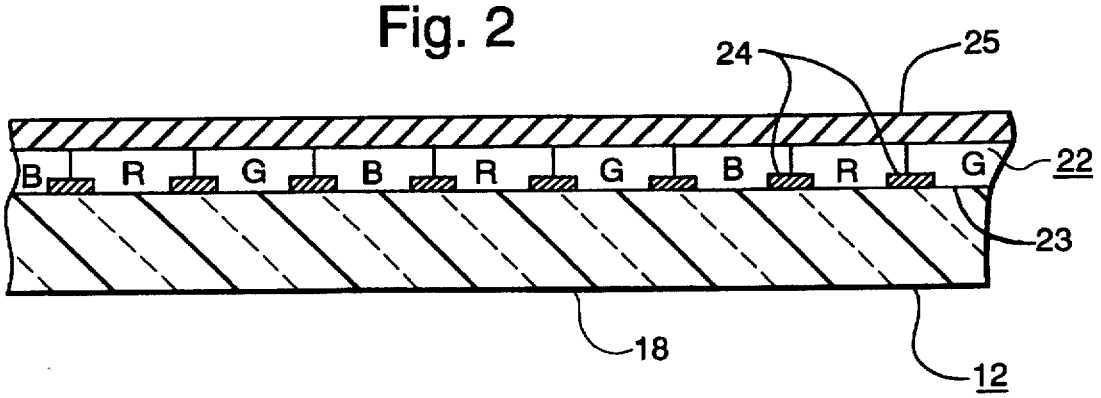
FIG. 2 is a section of a phosphor screen assembly of the tube shown in FIG. 1.

A cathode-ray tube 10, illustrated in FIG. 1, includes a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate 18 and a peripheral sidewall 19, having a seal edge 20 which is sealed to the funnel 15 by a glass frit 21. A three color luminescent phosphor screen 22 is carried on an interior surface 23 of the faceplate 18. The screen 22, shown in FIG. 2, preferably is a line screen which includes a multiplicity of screen elements comprised of red emitting, green-emitting and blue-emitting phosphor stripes, R, G and B, respectively, arranged in color groups or picture elements of three stripes, or triads, in a cyclic order and extending in a direction which is generally normal to the plane in which impinging electron beams are generated. In the normal viewing position for this embodiment, the phosphor stripes extend in the vertical direction. Preferably, the phosphor stripes are separated from each other by, and slightly overlap, a light-absorbing matrix 24, as is known in the art. Alternatively, the screen can be a dot screen. A thin conductive layer 25, preferably of aluminum, overlies the screen 22 and provides means for applying a uniform potential to the screen, as well as for reflecting light, emitted from the phosphor elements, through the faceplate 18. The screen 22, the matrix 24 and the overlying aluminum layer 25 comprise a screen assembly. A multi-apertured color selection electrode or shadow mask 26 is removably mounted, by conventional means 27, in predetermined spaced relation to the screen assembly.

An electron gun 28, shown schematically by the dashed lines in FIG. 1, is centrally mounted within the neck 14, to generate and direct three electron beams 29 along convergent paths, through the apertures in the mask 26, to the screen 22. The electron gun is conventional and may be any suitable gun known in the art.

The tube 10 is designed to be used with an external magnetic deflection yoke, such as yoke 30, located in the region of the funnel-to-neck junction. When activated, the yoke 30 subjects the three beams 29 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the deflection zone, are not shown.

The composition and process for producing a novel coating that improves the application of the phosphors, according to the present invention, are hereinafter described by way of Examples.

EXAMPLE

As shown in FIG. 3, the faceplate panel 12 is supported in a holder (not shown) and slowly rotated about the panel axis, A—A. The panel axis, A—A, is inclined at an angle α to the vertical, by about 5° to 85°. As the panel is slowly rotated about the axis A—A, a stream 32 of the novel surfactant solution is dispensed from a nozzle 34 at a low pressure so that the stream is said to be "limp" and follows an arcing trajectory. About 100 to 1000 ml. of the surfactant solution is dispersed from a reservoir 36 onto the interior surface 23 of each faceplate panel 12. The nozzle 34 is located so that the stream 32 is projected to contact the interior surface 23 substantially tangentially above the panel axis, A—A, so that the stream of the surfactant solution passes, after contact with the interior surface, through the panel axis and then radially across the interior surface. Upon contact, the surfactant solution follows the interior surface 23 because of interfacial tension and then passes down the inner surface of the panel sidewall 19 and drips off of the sealing edge 20, by gravity. During the latter stages of panel rotation, the surfactant solution is dried by infrared heaters (not shown) to form a surfactant layer 38 on the matrix 24 and on the exposed inner surface 23 of the faceplate panel 12, as shown in FIG. 4. The surfactant layer 38 may be characterized as a monolayer, that is, the layer thickness is substantially equivalent to that of a molecule of the surfactant constituents.

In the first EXAMPLE the surfactant solution comprises:

0.033 wt. % Pluronic L-92, available from BASF Wyandotte Corp., Parsippany, N.J., USA;

0.066 wt. % Tween - 20, available from ICI Americas, Inc., Wilmington, Del., USA; and the balance water.

The surfactants in the example are nonionic surfactants selected for their ability to solubilize oil or hydrophobic contaminants and for their ability to emulsify heavy oil. Surfactants which have a high solvency for oily contaminants have a hydrophile liophile balance (HLB) number greater than 16, while surfactants useful for emulsifying undissolved oil, preferably, have an HLB number less than 11. The HLB number is defined as being equal to E/5, where E is the weight percentage of ethylene oxide in the molecule of the surfactant. Pluronic L-92 has an HLB number <11 and is utilized to remove and emulsify oily contaminants from the matrix 24, while Tween - 20 has an HLB number >16 and solubilizes oily contaminants in the matrix. In combination, the two surfactants have the effect of dissolving and/or emulsifying the hydrophobic contaminants from the matrix 24 and providing a thin layer 38 of surfactant on the matrix in order to reduce graphite erosion of the matrix.

Additional examples of surfactant solutions are set out in the following TABLE.

| Example # | Constituents | Weight % | HLB Number | Source |
|---|---|---|---|---|
| 2 | Pluronic L-92 | 0.066 | <11 | BASF[1] |
| | Tween-20 | 0.132 | >16 | ICI[2] |
| | water | balance | — | — |
| 3 | Pluronic L-72 | 0.033 | <11 | BASF |
| | Tween-20 | 0.066 | >16 | ICI |
| | water | balance | — | — |
| 4 | Triton CF-54 | 0.05 | <11 | R & H[3] |
| | Triton GR-5 | 0.05 | >16 | R & H |
| | water | balance | — | — |
| 5 | Pluronic L-62 | 0.033 | <11 | BASF |
| | Tween-20 | 0.066 | >16 | ICI |
| | water | balance | — | — |

-continued

| Example # | Constituents | Weight % | HLB Number | Source |
|---|---|---|---|---|
| 6 | Pluronic L-92 | 0.05 | <11 | BASF |
| | Triton GR-5 | 0.05 | >16 | R & H |
| | water | balance | — | — |

1 = BASF Wyandotte, Parsippany, NJ, USA
2 = ICI Americas, Inc., Wilmington, DE, USA
3 = Rohm & Haas Chemical Co., Philadelphia, PA, USA After the surfactant layer 38 is dried, the faceplate panel 12 is preheated to a temperature within the range of 40° to 50° C. for the application of the green phosphor slurry (not shown), which contains a suitable sensitizer, as is known in the art. The slurry is dispensed onto the interior surface 23 of the panel, and the panel is rotated and tilted, as is known in the art, to distribute the phosphor slurry across the matrix 24 and the overlying surfactant layer 38. Then, the panel is rotated at a high speed to remove the excess slurry, and the slurry is dried by infrared heaters (also not shown) to form a substantially uniform, green phosphor layer. Next, the shadow mask 26 is mounted within the faceplate panel 12, and the panel and shadow mask are positioned on a lighthouse (not shown) which projects light through the openings in the shadow mask from an angle corresponding to the angle the electron beams of the CRT will take to impinge on the green phosphor screen elements. The light passing through the openings in the shadow mask selectively alters the solubility of the green phosphor layer. The faceplate panel is removed from the lighthouse, and the shadow mask is removed from the panel. Then, the green phosphor layer is developed with water to remove the more soluble areas therefrom, leaving the green phosphor screen elements. The process is repeated twice more for the blue and red phosphors. In each instance, the light from the lighthouses is incident on the blue and red phosphor layers at angles corresponding to the angles of the respective incident electron beams. The result is shown in FIG. 5 where the green-, blue- and red-emitting phosphors (G, B and R) are disposed within the openings in the matrix 24 and overlie portions of the matrix surrounding each opening.

Faceplate panels produced using the novel surfactant solutions, and the resultant surfactant layer 38, have shown improved phosphor coating uniformity for each of the phosphor colors. The surfactant layer 38 has reduced the number of phosphor voids by more than 75% for the first (green) phosphor deposited, over 50% for the second (blue) phosphor deposited, and over 25% for the third (red) phosphor deposited. The reduction in phosphor voids is attributed to the ability of the surfactant to remove oily contaminants and increase the retention of the phosphor to the underlying substrate. Additionally, noticeable improvement has been obtained in reducing graphite contamination of the green slurry. This has been confirmed by inspecting the reclaimed slurry and the excess slurry spin-off for evidence of graphite contamination. The substantial reduction in the amount of graphite in the reclaimed excess green slurry confirms that there is practically no erosion of graphite from the matrix during application and distribution of the green slurry.

After the phosphor screen 22 is formed, the phosphor screen is filmed, aluminized, and baked, as is known in the art, to complete the phosphor screen assembly.

What is claimed is:

1. A method of manufacturing a phosphor screen on an interior surface of a faceplate panel comprising the steps of:

forming a light-absorbing matrix on an interior surface of said faceplate panel;

applying an aqueous surfactant solution, containing at least two surfactants, thereto, wherein one of said surfactants has a hydrophile liophile balance (HLB) number greater than 16 to solubilize oily contaminants and the other surfactant has an HLB number less than 11 to emulsify undissolved oily contaminants of said matrix, in combination, said two surfactants also reduce erosion of said matrix; and serially applying three light-emitting phosphors (G, B, R) to said interior surface of said faceplate panel to form said phosphor screen.

2. The method as described in claim 1, wherein said aqueous surfactant solution is dried to form a thin layer of surfactant, at least on said matrix.

3. The method as described in claim 1, wherein said surfactants are selected from the group consisting of Pluronic L-92, Pluronic L-72, Pluronic L-62, Triton CF-54, Triton GK-5 and Tween - 20.

4. The method as described in claim 3, wherein said aqueous surfactant solution has a surfactant concentration of between 0.1 wt. % and 0.2 wt. %, the balance being water.

* * * * *